United States Patent [19]

Kamei et al.

[11] 4,389,595

[45] Jun. 21, 1983

[54] FLUORESCENT LAMP

[75] Inventors: Taketo Kamei; Motokazu Hayashi, both of Yokosuka, Japan

[73] Assignee: Tokyo Shibaura Denki Kabushiki Kaisha, Kawasaki, Japan

[21] Appl. No.: 190,252

[22] Filed: Sep. 24, 1980

[30] Foreign Application Priority Data

Sep. 29, 1979 [JP] Japan ..... 54-135196[U]
Sep. 29, 1979 [JP] Japan ..... 54-135197[U]
Sep. 29, 1979 [JP] Japan ..... 54-135208[U]

[51] Int. Cl.[3] ..... H01J 7/44; H01J 17/34; H01J 19/78; H01J 29/96; H01K 1/62

[52] U.S. Cl. ..... 315/57; 313/493; 315/51; 315/50

[58] Field of Search ..... 313/493; 315/51, 53, 315/58, 57, 50

[56] References Cited

U.S. PATENT DOCUMENTS 4,173,730 11/1979 Young et al. ..... 315/53
4,178,535 12/1979 Miller ..... 315/53
4,196,374 4/1980 Witting ..... 315/58
4,199,708 4/1980 Lauwerijssen ..... 313/493
4,270,071 5/1981 Morton ..... 315/58
4,272,703 6/1981 Eckberg ..... 315/51
4,300,073 11/1981 Skwirut et al. ..... 313/493
4,319,162 3/1982 Hoeh ..... 313/493
4,337,414 6/1982 Young ..... 313/493

*Primary Examiner*—Saxfield Chatmon, Jr.
*Attorney, Agent, or Firm*—Cushman, Darby & Cushman

[57] ABSTRACT

An envelope comprises a bowl-shaped component with a screw base and a bulb of a translucent material. A fluorescent tube bent a plurality of times and a reactance ballast are encased in the envelope. This fluorescent tube and the reactance ballast are fixed to a supporting plate. The bend part of the fluorescent tube protrudes through the supporting plate toward the side of the bowl-shaped component. A plurality of openings are formed in the bowl-shaped component at parts corresponding to the bend part of the fluorescent tube. A plurality of openings are formed in the supporting plate at parts near the reactance ballast fixed to the supporting plate.

22 Claims, 8 Drawing Figures

FLUORESCENT LAMP

BACKGROUND AND SUMMARY OF THE INVENTION

This invention relates to a fluorescent lamp and, more particularly, to a fluorescent lamp used in place of an incandescent lamp for saving electric power.

Fluorescent lamps are widely used for their excellent luminous efficacy and low power requirement. However, since fluorescent lamps are of generally straight or annular shape, they cannot be directly coupled to receptacles with screw bases of incandescent lamps. Recently, fluorescent lamps replaceable with the incandescent lamps are being developed for this reason. In a fluorescent lamp of this type, a reactance ballast and a starter circuit are assembled in an envelope with a base of the same type as that of an incandescent lamp (e.g., Type E-26); this fluorescent lamp is turned on as it is screwed into a receptacle which is normally used for an incandescent lamp.

However, with such a conventional fluorescent lamp, since the fluorescent tube and the reactance ballast are encased inside a globe member, the air inside the globe member is heated by the energized fluorescent tube and the operated reactance ballast. When the fluorescent tube is illuminated for an extended period of time in air at such a high ambient temperature, the mercury vapor pressure of the fluorescent tube exceeds the optimal vapor pressure. As a result, the intensity of ultraviolet rays inside the fluorescent tube and the luminance of visible light rays emitted from the fluorescent material coated on the inner surface of the fluorescent tube decrease considerably, disadvantageously degrading the luminous efficacy of the fluorescent lamp.

Further, when the temperature inside the globe member is raised, the current flowing through the fluorescent lamp increases with this temperature increase, resulting in generation of heat by the reactance ballast. The heat generated by the reactance ballast raises the temperature inside the globe member and degrades the luminous efficacy of the fluorescent tube. In the worst case, the reactance ballast may burn out completely.

It is, therefore, an object of this invention to provide a fluorescent lamp wherein the ambient temperature of the fluorescent tube encased in the envelope is not raised so much as to adversely affect the fluorescent tube.

In accordance with this invention, a fluorescent tube with bend parts is encased in an envelope with a screw base. A reactance ballast for regulating the current to flow through the fluorescent tube is fixed to a supporting plate which is attached to the fluorescent tube. Openings are formed in the envelope for expelling heat generated inside the envelope while the fluorescent tube is lit.

BRIEF DESCRIPTION OF THE ACCOMPANYING DRAWINGS

This invention can be more fully understood from the following detailed description when taken in conjunction with the accompanying drawings, in which.

DETAILED DESCRIPTION OF THE PREFERRED EXEMPLARY EMBODIMENTS

Figure 2:
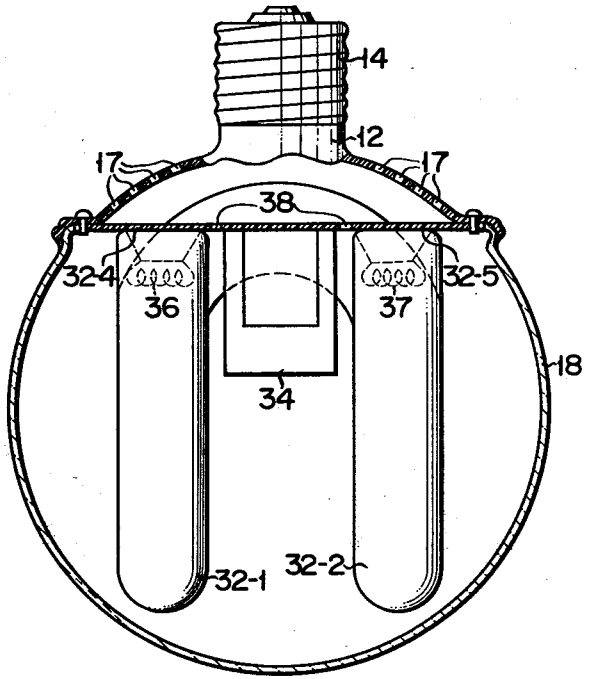
FIG. 2 is a view illustrating the internal construction of the embodiment shown in FIG. 1 along the line 2—2.
Figure 1:
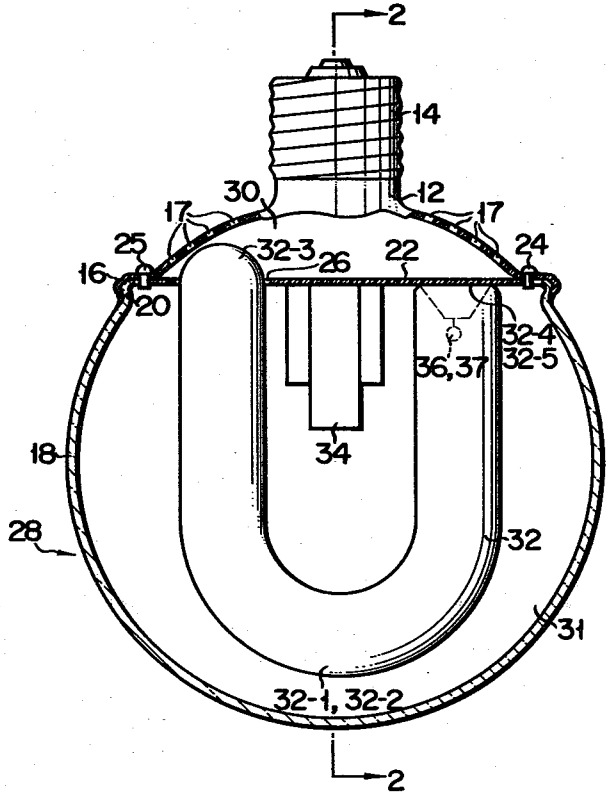
FIG. 1 is a view illustrating the internal construction of a fluorescent lamp wherein a fluorescent tube bent at a plurality of bend parts is encased in an envelope in accordance with an embodiment of this invention.
Figure 3:
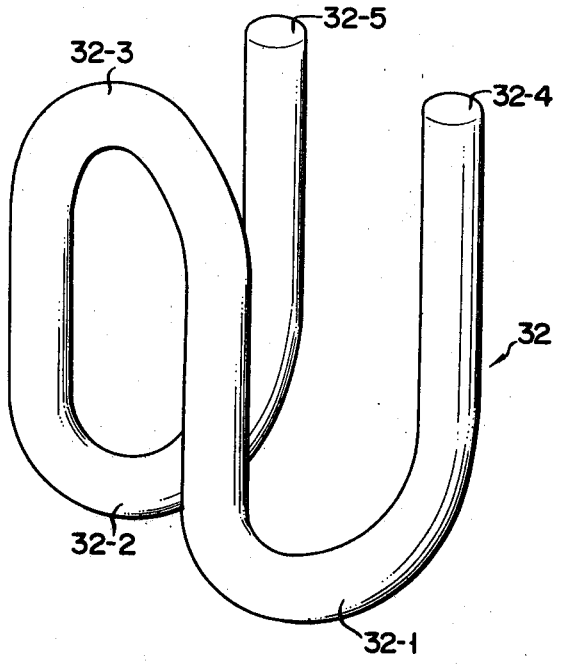
FIG. 3 is a perspective view of the fluorescent tube used in the embodiment shown in FIGS. 1 and 2.

In the embodiment shown in FIGS. 1 and 2, a bowl-shaped component 12 comprises a bowl-shaped member of a predetermined thickness, for example about 1 mm, at the center of the outer surface of which is fixed a screw base 14 of a type such as E-26. The peripheral edge of the open end of the bowl-shaped component 12 has a flange 16. The bowl-shaped component 12 further has a plurality of arc-shaped openings 17 along the peripheral edge of the open end. To this flange 16 of the bowl-shaped component 12 is mounted a globe member 18 which has a thickness of about 1 mm and an outer diameter of about 110 mm and which is made of a translucent material (e.g., polycarbonate resin) colored, for example, in white. The globe member 18 is, for example, of substantially spherical shape and has an open end 20 to fit with the flange 16 of the bowl-shaped component 12. A bulge formed at the peripheral edge of the open end 20 attaches to the inner surface of the flange 16 so that the open end 20 and the flange 16 detachably fit with each other. A supporting plate 22 is fixed to the base flange 16 by screw members 24, 25, inserted from the exterior of bowl-shaped component 12. Thus, the space inside envelope 28 consisting of both bowl-shaped component 12 and globe member 18 is divided by the supporting plate 22 into a base side space 30 and a globe side space 31. A fluorescent tube 32 and a reactance ballast 34 are fixed to the supporting plate 22. The light emitting parts of the fluorescent tube 32 have a U-shaped bend part 32-3, and a pair of leg parts respectively extending from both ends of the bend part 32-3. These leg parts are bent respectively in a U-shaped in a direction perpendicular to a plane which includes the bend part 32-3. The U-shaped tube parts 32-1, 32-2 of leg parts are mutually parallel. Electrodes 36 and 37 are respectively sealed on the tube ends 32-4 and 32-5. Thus, both the tube ends 32-4 and 32-5 of the fluorescent tube 32 are mounted to the supporting plate 22 and are encased in the globe side space 31. The bend part 32-3 protrudes through a hole 26 formed in the supporting plate 22 into the base side space 30. There is clearance, for example 1.5 mm, between the hole 26 and the outsurface of the bend parts 32-1 and 32-2. The reactance ballast 34 is fixed to the central part of the supporting plate 22 and is surrounded by the bent type fluorescent tube 32 disposed in the globe side space 31. A plurality of openings 38 are formed in the supporting plate 22 in the vicinity of the reactance ballast 34. A fluorescent material is coated on the inner surface of the fluorescent tube 32, and a predetermined amount of mercury and an inert gas are sealed inside the tube. The electrodes 36 and 37 are connected to the screw base 14 through the electrical intermediacy of the reactance ballast 34 and a glow starter (not shown, but encased in the base side space 30).

In the embodiment of this invention of the above construction, the bend part 32-3 of the fluorescent tube 32 protrudes through the supporting plate 22 into the base side space 30 so that the heat generated at the bend part 32-3 of the lit tube is expelled to the outside by the openings 17 of the bowl-shaped component 12, and the supporting plate 22 shields the bend part 32-3 from the heat generated in the globe side space 31 (e.g., 65° to 75° C.). Therefore, the tube wall of the bend part 32-3 of the lit tube is kept at a relatively low temperature (e.g., 50° to 53° C.). Thus, the mercury vapor pressure within the bend part 32-3 is low, and the mercury vapor condenses at the bend part 32-3 and on the inner tube wall near the bend part 32-3. This condensation of the mercury vapor limits the mercury vapor density during the discharge of the fluorescent tube 32, so that the overall mercury vapor pressure is kept at an optimal low value (e.g., 5 to $6\times10^{-3}$ mmHg). The degradation of the luminous efficacy as well as the increase in the current flowing through the fluorescent lamp are prevented.

Part of the heat generated in the globe side space 31 by the electrodes 36 and 37 and the reactance ballast 34 of the lit tube is expelled to the outside of the envelope 28 through the openings 38 formed in the supporting plate 22 and the openings 17 formed in the bowl-shaped component 12 so that the temperature of the globe side space 31 is not raised excessively.

Figure 5:
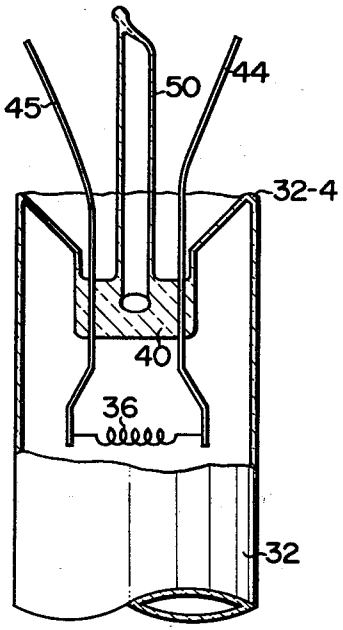
FIG. 5 is a partially cutaway enlarged view of part of the fluorescent tube of the embodiment of FIG. 4.
Figure 4:
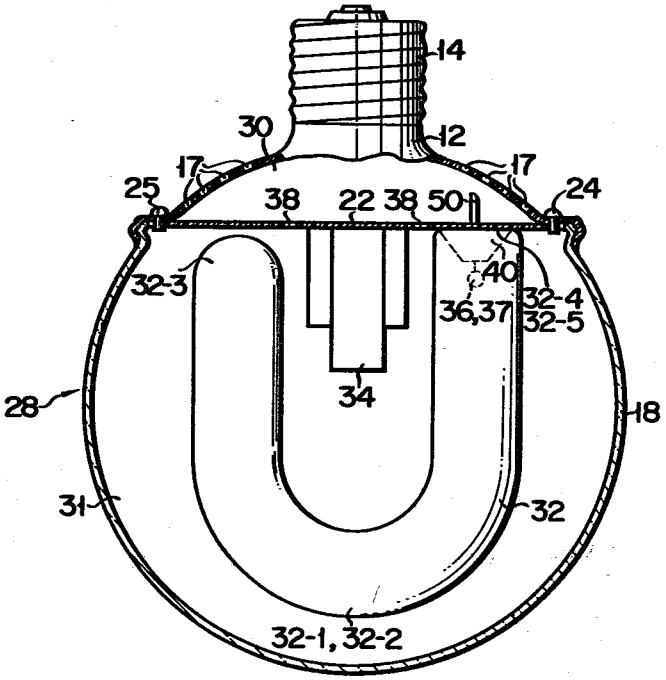
FIG. 4 is a view illustrating the internal construction of a fluorescent lamp in accordance with another embodiment of this invention wherein an exhaust tube of the fluorescent tube protrudes through a supporting plate.

In the embodiment shown in FIGS. 4 and 5, a stem 40 which provides an exhaust tube 50 is sealed at one end, for example, at the tube end 32-4, of the fluorescent tube 32 fixed by the supporting plate 22 inside the globe side space 31 of the envelope 28. The exhaust tube 50 extends through the supporting plate 22 and protrudes into the base side space 30. A plurality of openings 17 of arc-shaped sections are formed along the circumference of the bowl-shaped component 12 at the part facing the exhaust tube 50. FIG. 5 is a partially cutaway enlarged view of the tube end 32-4 of the fluorescent tube 32 at the side of the electrode 36. The fluorescent tube is manufactured by evacuating the air inside the fluorescent tube 32 to a predetermined degree of vacuum, and subsequently introducing a predetermined amount of mercury and inert gas into fluorescent tube 32, after which the exhaust tube 50 is sealed. Lead wires 44 and 45 are electrically connected to the electrode 36.

In the embodiment of the above construction, the exhaust tube 50 of the fluorescent tube 32 is shielded by the supporting plate 22 from the heat generated in the globe side space 31 of the envelope 28 while the fluorescent tube 32 is lit. Furthermore, it is cooled by outside air introduced through the plurality of openings 17 formed in the bowl-shaped component 12, so that the temperature of the exhaust tube 50 is lower than that of the globe side space 31. Consequently, the mercury vapor pressure inside the exhaust tube 50 is kept low, and the mercury sealed inside the fluorescent tube 32 condenses on the inner wall of the exhaust tube 50. As a result, the mercury vapor pressure inside the fluorescent tube 32 can be kept at an optimal vapor pressure, regardless of the increase in temperature of the globe side space 31 due to the heat generated while the fluorescent tube 32 is lit. Thus, the degradation of the luminous efficacy may be eliminated.

Figure 7:
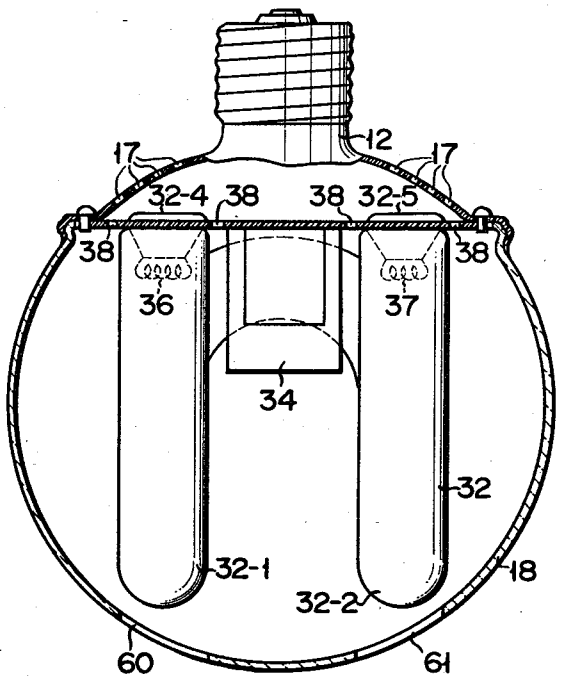
FIG. 7 is a view illustrating the internal construction of the embodiment shown in FIG. 6 along the line 7—7.
Figure 6:
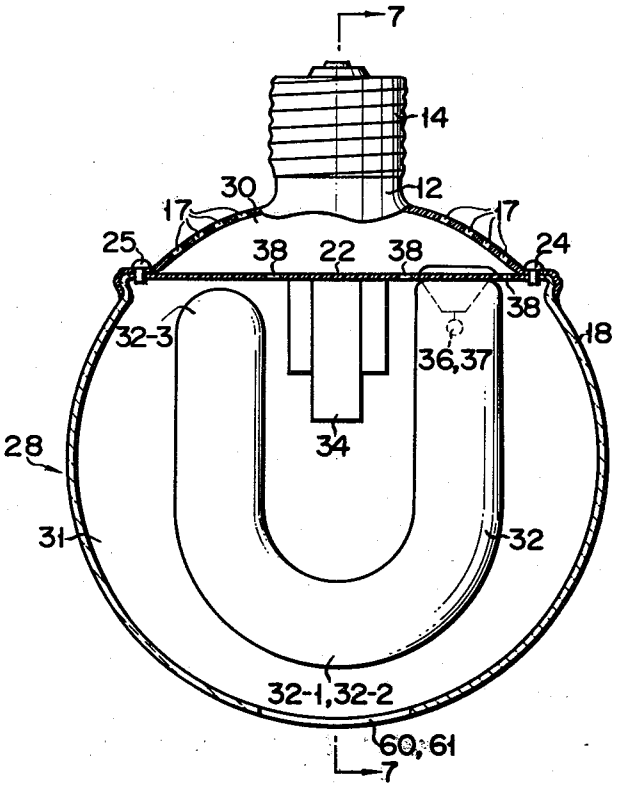
FIG. 6 is a view illustrating the internal construction of a fluorescent lamp in accordance with still another embodiment of this invention, wherein openings are formed at a part of the globe member facing the bent part of the fluorescent tube.

In accordance with still another embodiment shown in FIGS. 6 and 7, the fluorescent tube 32 and the reactance ballast 34 are fixed to the supporting plate 22 and are encased in the globe side space 31 of the envelope 28. On parts of the globe member 18 facing the U-shaped tube parts 32-1 and 32-2 are formed two openings 60 and 61. A plurality of openings 38 are formed in the supporting plate 22 near the reactance ballast 34, and a plurality of openings 17 of the arc-shaped sections are formed in the bowl-shaped component 12 with the screw base 14 along its circumference.

In accordance with the embodiment of FIGS. 6 and 7, the U-shaped tube parts 32-1 and 32-2 of the fluorescent tube are further cooled by outside air flowing in through the two openings 60 and 61, so that the mercury vapor pressure inside the fluorescent tube 32 may be kept at the optimal value (e.g., 5 to $6\times10^{-3}$ mmHg). In addition, through the aid of the openings 60 and 61, the openings 38 formed in the supporting plate 22, and the openings 17 formed in the bowl-shaped component, circulation of the air heated inside the envelope 28 is improved, and in particular the temperature of the wall of the tube 32 in the vicinity of the openings 60 and 61 is kept at about 43° C. The mercury vapor pressure of the fluorescent tube 32 is kept low and the current flowing through the fluorescent lamp is prevented from increasing, so that burning of the reactance ballast due to the generated heat may be advantageously prevented.

Although this invention has been described and illustrated with reference to its particular embodiments, various changes and modifications obvious to those skilled in the art are contemplated to be within the spirit and the scope of this invention. For example, although a plurality of holes are formed in a single supporting plate in the above embodiments, the supporting plate may be divided into two parts and the bend part of the fluorescent tube may protrude to the base side space through the space formed between these separated plates. Further, the positions and the shapes of the openings are not limited to the specific construction described above, but two further exhaust tubes may be formed at both tube ends of the fluorescent tube and these two exhaust tubes may protrude into the base side space.

Figure 8:
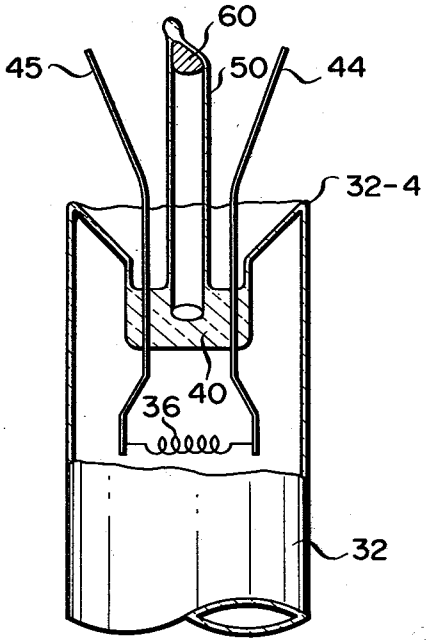
FIG. 8 is a partially cutaway enlarged view of part of a fluorescent tube in which is sealed an amalgam material.

Further, a method may be adapted for keeping the vapor pressure of the mercury sealed inside the fluorescent tube low by utilizing an amalgam material sealed in tube 32. As illustrated in FIG. 8, an amalgam material 60 (about 100 to 170 mg) is sealed, for example, within exhaust tube 50. Amalgam materials, such as indium, cadmium, lead, zinc and the like are generally known. Indium is especially preferred for use in the embodiment shown in FIG. 8, since it easily alloys itself with mercury and absorbs mercury well. Consequently, in the case of using the fluorescent tube 32 in which indium is sealed, when the ambient temperature inside the envelope increases and the mercury vapor pressure inside the fluorescent tube 32 increases, the indium absorbs the mercury. The exhaust tube 50 in which the indium is sealed is cooled by outside air introduced through the holes formed in the bowl-shaped component 12, so that the mercury vapor pressure inside the fluorescent tube 32 may be effectively maintained at the optimal value, and thus the area in openings 17 of bowl-shaped component 12 may be advantageously made smaller.

What we claim is:

1. A fluorescent lamp comprising:

an envelope including a hollow globe member made of at least a translucent material and defining an open end, and a base member including a screw base, said base member attached to and covering said open end of said globe member, said globe and said base members together defining an inner space;

a fluorescent tube comprising a light emitting tube section which is encased in said envelope and which is formed in a folded U-shape having two ends, a U-shaped end portion and a pair of leg portions parallel to said U-shaped end portion and respectively extending from said two ends, a pair of electrodes respectively formed at said two ends, an exhaust tube protruding from at least one of said two ends, and a pair of lead wires connected to said electrodes and respectively extending from said two ends;

plate means disposed in said envelope for dividing said inner space of said envelope into a globe side space and a base side space for supporting said fluorescent tube at least at said two ends thereof so that most of said fluorescent tube is enclosed within said globe side space, said plate means including means permitting a portion of said fluorescent tube to extend into said base side space through said plate means, said portion thereby forming a cooling area on said fluorescent tube;

reactance ballast means provided on said plate means enclosed in said globe side space and connected to said lead wires for regulating current flowing through said fluorescent tube; and cooling means defining openings in said envelope for expelling heat generated by said fluorescent tube and said reactance ballast means to the exterior of said envelope.

2. A fluorescent lamp according to claim 1, wherein said plate means further includes means defining cooling openings for expelling heat generated in said globe side space during actuation of said fluorescent tube to at least said base side space.

3. A fluorescent lamp according to claim 2, wherein said cooling openings of said plate means are defined in the vicinity of said reactance ballast means.

4. A fluorescent lamp according to claim 1 wherein said cooling means includes means defining apertures in said base member for cooling said base side space.

5. A fluorescent lamp according to claim 1, wherein said permitting means of said plate means defines an opening through which said U-shaped portion of said light emitting section at least partially extends into said base side space.

6. A fluorescent lamp according to claim 4, wherein said opening of said plate means is arranged so as to define a gap between the outer surface of said fluorescent tube extending through said opening and said base member.

7. A fluorescent lamp according to claim 5, wherein said plate means further includes means defining cooling openings for expelling heat generated in said globe side space during actuation of said fluorescent tube to at least said base side space.

8. A fluorescent lamp according to claim 7, wherein said cooling openings of said plate means are defined in the vicinity of said reactance ballast means.

9. A fluorescent lamp according to claim 5 wherein said cooling means includes means defining apertures in said base member for cooling said base side space.

10. A fluorescent lamp according to claim 1, wherein said permitting means of said plate means defines an opening through which said exhaust tube at least partially extends into said base side space.

11. A fluorescent lamp according to claim 10, wherein said plate means further includes means defining cooling openings for expelling heat generated in said globe side space during actuation of said fluorescent tube to at least said base side space.

12. A fluorescent lamp according to claim 11, wherein said cooling openings of said plate means are defined in the vicinity of said reactance ballast means.

13. A fluorescent lamp according to claim 10 wherein said cooling means includes means defining apertures in said base member for cooling said base side space.

14. A fluorescent lamp according to claim 1 wherein said permitting means of said plate means defines two apertures through which said two ends of said light emitting section respectively extend at least partially into said base side space.

15. A fluorescent lamp according to claim 14 wherein said plate means further includes means defining cooling openings for expelling heat generated in said globe side space during actuation of said fluorescent tube to at least said base side space.

16. A fluorescent lamp according to claim 15 wherein said cooling openings of said plate means are defined in the vicinity of said reactance ballast means.

17. A fluorescent lamp according to claim 14 wherein said cooling means includes at least two openings defined in said globe member in an opposing relationship to said leg portions of said light emitting section.

18. A fluorescent lamp according to claim 17 wherein said cooling means further includes means defining apertures in said base member for cooling said base side space.

19. A fluorescent lamp according to claim 1 wherein said cooling means includes at least two openings defined in said globe member in an opposing relationship to said leg portions of said light emitting section.

20. A fluorescent lamp according to claim 1 wherein said envelope defines an inner space having a substantially spherical shape.

21. A fluorescent lamp according to claim 1 wherein an amalgam material is sealed in said fluorescent tube.

22. A fluorescent lamp according to claim 21 wherein said amalgam material is at least sealed in said exhaust tube.

* * * * *